United States Patent [19]

Tower et al.

[11] 4,441,666

[45] Apr. 10, 1984

[54] SEWING MACHINE ADAPTER

[76] Inventors: Ronald H. Tower; Elizabeth S. Tower, both of 866 W. Isabella, Mesa, Ariz. 85202

[21] Appl. No.: 388,889

[22] Filed: Jun. 16, 1982

[51] Int. Cl.[3] ..... B65H 49/18

[52] U.S. Cl. ..... 242/134; 242/136

[58] Field of Search ..... 242/129.5–129.7, 242/134, 136, 139; 112/231, 302, 257; 223/106; D3/23, 24

[56] References Cited

U.S. PATENT DOCUMENTS

| | | | |
|---|---|---|---|
| 691,408 | 1/1902 | Reinhold | 242/134 |
| 2,144,996 | 1/1939 | Silvey | 242/134 |
| 2,402,696 | 6/1946 | Track | 242/139 |
| 3,444,833 | 5/1969 | Blackwood et al. | 242/134 X |
| 3,591,105 | 7/1971 | Perlino | 242/129.7 |
| 3,987,978 | 10/1976 | Alberelli et al. | 242/134 |
| 4,022,394 | 5/1977 | Gudde | 242/129.6 |

*Primary Examiner*—Leonard D. Christian

[57] ABSTRACT

An adapter for use on a sewing machine which is equipped with first and second spool pins permits the machine to operate with non-conventional spools such as plastic or cardboard tube spools, small conical base spools, and large spools having a large bore therethrough. A yoke is rotatably mounted on a stabilizing bar which in turn is mounted on the spool pins. The yoke supports first and second mounting fins. A rod is hingedly coupled to one of the mounting fins and is capable of assuming stable horizontal or vertical positions. Plastic or cardboard tube spools may be mounted on the rod when in a horizontal position. The yoke is then adjusted so as to minimize the distance between the point the thread comes off the spool and the first thread guide on the machine. Larger spools may be mounted on the first mounting fin or, when the rod is in a vertical position, on the second mounting fin.

8 Claims, 9 Drawing Figures

SEWING MACHINE ADAPTER

BACKGROUND OF THE INVENTION

This invention relates generally to sewing machine apparatus and, more particularly, to an adapter for use in conjunction with the spool pins of a conventional home sewing machine so as to enable the machine to use non-conventional spools of thread such as plastic or cardboard tube spools, small conical base spools, and spools having large central bore therethrough.

Home sewing machines are widely used so as to enable individuals to reduce costs associated with buying new clothes, to repair used clothing, to create designer clothing, etc. Unfortunately, most home sewing machines include first and second spool pins which are specifically intended to accommodate relatively small spools of thread having a small diameter bore therethrough. This precludes use of spools of thread of the more non-conventional nature or of the type which are used in conjunction with industrial type sewing machines. Such non-conventional spools may include plastic or cardboard tube spools, small conical base tubes, and spools having large central bores therethrough.

SUMMARY OF THE INVENTION

It is an object of the present invention to provide an apparatus for use in conjunction with a home sewing machine which enables use of non-conventional spools of thread such as plastic or cardboard tube spools, small conical base tubes, and spools having large central bores therethrough.

It is a further object of the present invention to provide an adapter which is simple to use and economical to manufacture for insertion on the spool pins of a conventional home sewing machine so as to enable it to operate with non-conventional spools of thread.

According to a broad aspect of the invention there is provided an adapter for use on a sewing machine equipped with first and second spool pins, said adapter for enabling said machine to operate with non-conventional spools of thread such as plastic or cardboard tube spools, small conical base spools and large spools having a large bore therethrough, comprising: first means for mounting said adapter on said spool pins; yoke means rotatably coupled to said first means; a first vertical mounting fin fixedly coupled to said yoke means; a second vertical mounting fin fixedly coupled to said yoke means; and a mounting rod hingedly coupled to said first mounting fin and capable of assuming stable horizontal and vertical positions.

The above and other objects, features and advantages of the present invention will be more clearly understood from the following detailed description taken in conjunction with the accompanying drawings, in which:

DESCRIPTION OF THE PREFERRED EMBODIMENT

Figure 1:
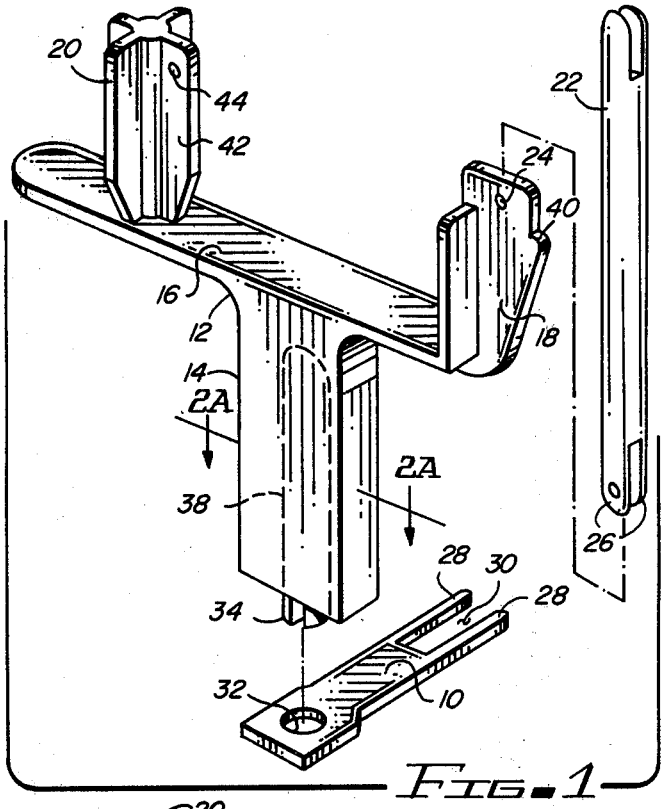
FIG. 1 is an isometric view of the inventive adapter with its stabilizing bar and rod removed from the yoke.

Referring to FIG. 1, the inventive adapter includes is stabilizer bar 10, a yoke 12 having a vertical portion 14 and a horizontal portion 16, a first mounting fin 18 at one end of horizontal portion 16, a second mounting fin 20 position proximate the other end of horizontal portion 16, and a mounting rod 22 hingedly coupled to the first mounting fin 18 as for example by semi-sperical dimples 24 on mounting fin 18 which engage correspondently shaped recesses in the inner surfaces of slot formed by ends 26 of rod 22.

Figure 2A:
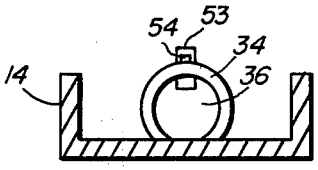
FIG. 2A is a bottom view of the vertical portion of the yoke, delineating the detent flat and the compensation compression finger.
Figure 2B:
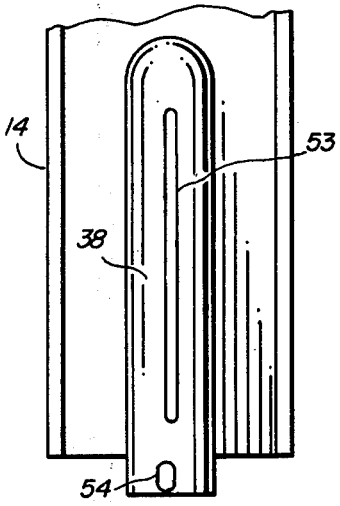
FIG. 2B is a back view of a portion of the vertical section of the yoke, delineating the detent flat and the compensation compression finger.

Stabilizing bar 10 includes first and second prongs 28 forming slot 30 therebetween. Stabilizing bar 10 is also equipped with an aperture 32 which is rotatably secured around a generally cylindrical projection 34 and detent flat 54 (better seen in FIG. 2A). Cylindrical projection 34 having central bore 36 therethrough is actually a continuation of a tunnel like protrusion 38 having a central box 36, illustrated by dotted lines in FIG. 1 and more clearly seen in FIG. 2B which is a back view of the vertical portion 14 of yoke 12. As can be seen, tunnel like protrusion 38 extends up along the back side of vertical section 14 that is used to accommodate a spool pin on a homesewing machine by permitting the spool pin to pass through aperture 32 and central bore 36.

A spool pin size compensating compression finger 53 integral to the vertical section 14 is used to accommodate different diameter spool pins to enhance versatility and adaptability, while minimizing wobble of yoke 12. Thus, yoke 12 may be rotated with respect to stabilizer bar 10 so that thread coming off a spool mounted on the adapter may lead directly to the first thread guide on the machine. For example, the yoke may be rotated in discrete rotational intervals by using a suspension system interlocked to circumferential flats which imparts a ratcheting effect to the unit. This ratcheting action allows the unit to be rotated in either direction, and rotation may be stopped in discrete increments for optimum alignment of the device.

Mounting fin 18 is equipped with a step 40 which, as will be described below, supports a small conical base spool when rod 22 is in the vertical position.

Mounting fin 20 is a cross-fin comprised of a plurality of blades. In the embodiment shown, four blades are positioned generally at right angles to each other. As will be described later, large spools having large bores therethrough may be positioned over its cross-fin for the purpose of filling bobbins. Blade 42 of cross-fin 20 is equipped with means for engaging the non-hinged end of rod 22 (not shown) so that the rod never falls below the horizontal position. This may be accomplished, for example, by semi-spherical dimples 44 on both sides of blade 42.

From the point of view of construction, the yoke, mounting fins, rod and stabilizer bar may be manufactured from any material which offers the required strength and rigidity; e.g. plastic. The yoke including vertical portion 14 and horizontal portion 16, mounting fins 18 and 20, and the compression finger 53 may be formed integrally with each other during well known molding processes.

Figure 3:
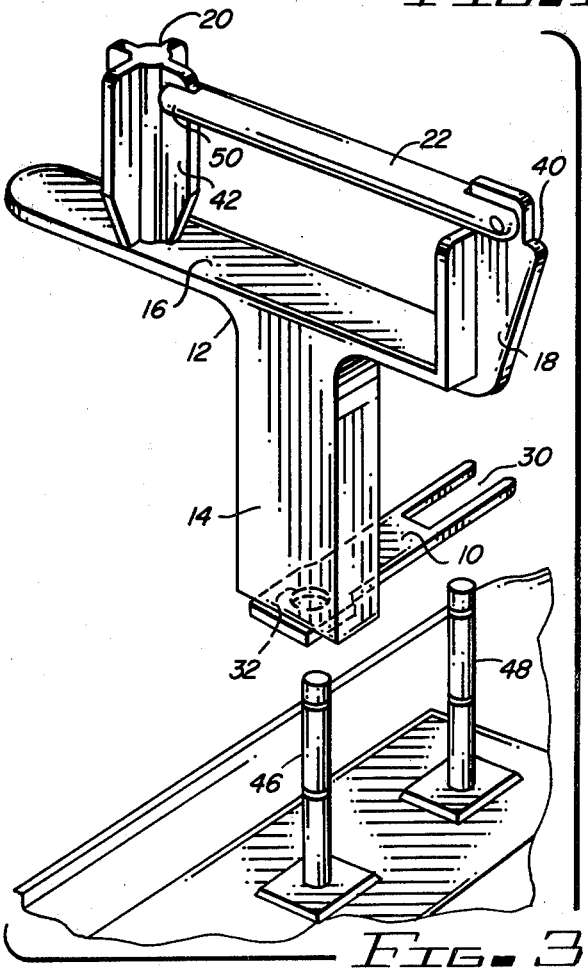
FIG. 3 is an isometric view of the inventive adapter with its mounting rod in the horizontal position and with its stabilizing bar coupled to the vertical portion of the yoke, and illustrates how the apparatus may be coupled to or positioned on the spool pins of the conventional home sewing machine.

FIG. 3 is an isometric view illustrating the stabilizer bar 10 rotatively coupled to yoke 12 and positioned above spool pins 46 and 48 which can be found on most home sewing machines. Spool Pin 46 can pass through aperture 32 in stabilizer bar 10 and through bore 36 in tunnel like protrusion 38 (not shown). Spool pin 48 resides in slot 30. It should be clear that the stabilizer bar, due to slot 30, may be mounted on sewing machines wherein the distance between spool pins 46 and 48 may vary. Thus spool pin 48 may reside at any location within slot 30 and still properly secure the adapter on the sewing machine.

FIG. 3 also illustrates the non-hinged end of rod 22 as comprising end members 50 forming a slot therebetween into which blade 42 of multi-fin 20 extends. As stated previously, means are provided on blade 42 for preventing rod 22 from dropping below a horizontal position.

Figure 4:
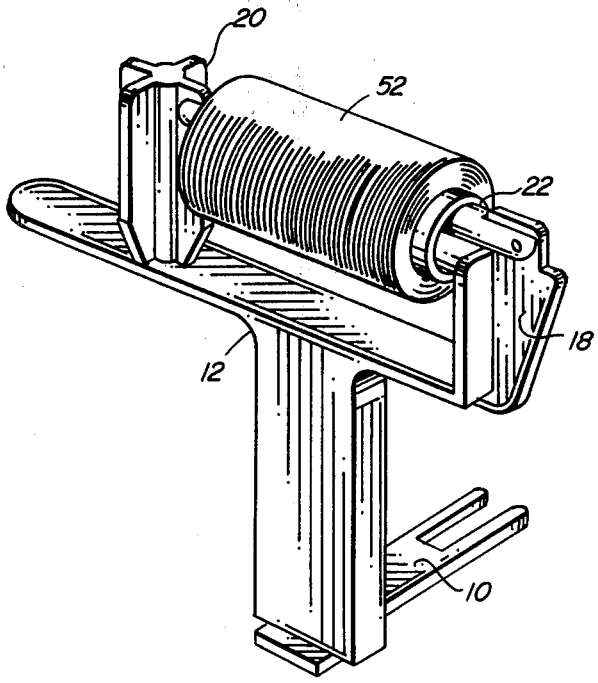
FIG. 4 is an isometric view illustrating how a plastic or cardboard tube spool is mounted on the inventive adapter.
Figure 5:
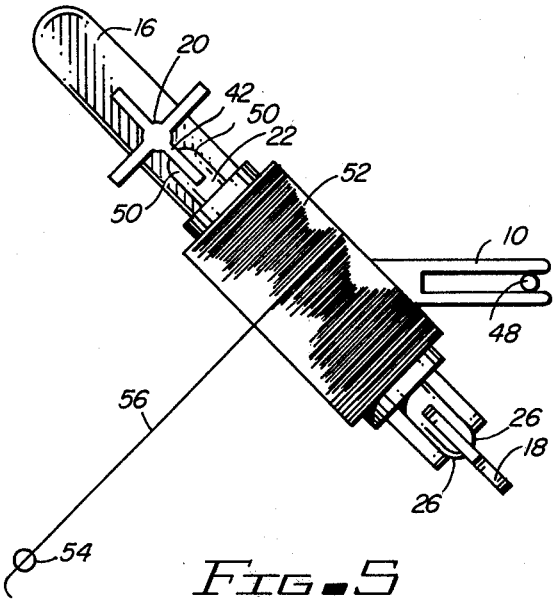
FIG. 5 is a top view illustrating how the yoke portion should be rotated on the stabilizing bar so that the thread coming off the spool goes directly to the first thread guide on the sewing machine.

The inventive adapter is designed so as to accommodate a variety of non-conventional thread spools. For example, FIG. 4 illustrates a cardboard or plastic tube spool 52 mounted on horizontal rod 22. As stated previously, once the stabilizing bar is secured on the sewing machine spool pins, the yoke should be rotated such that the thread from spool 52 feeds directly to the first thread guide as is shown in FIG. 5. As is shown, the yoke has been rotating such that thread 56 is fed directly to the first thread guide 54. As thread 56 is withdrawn from spool 52, rod 22 is maintained in position due to its engagement with blade 42 of cross fin 20. Spool 52 is maintained in position by means of the stabilizing bar 10's frictional contact between the slot 30 and the end portion of the cylindrical projection 34.

Figure 6:
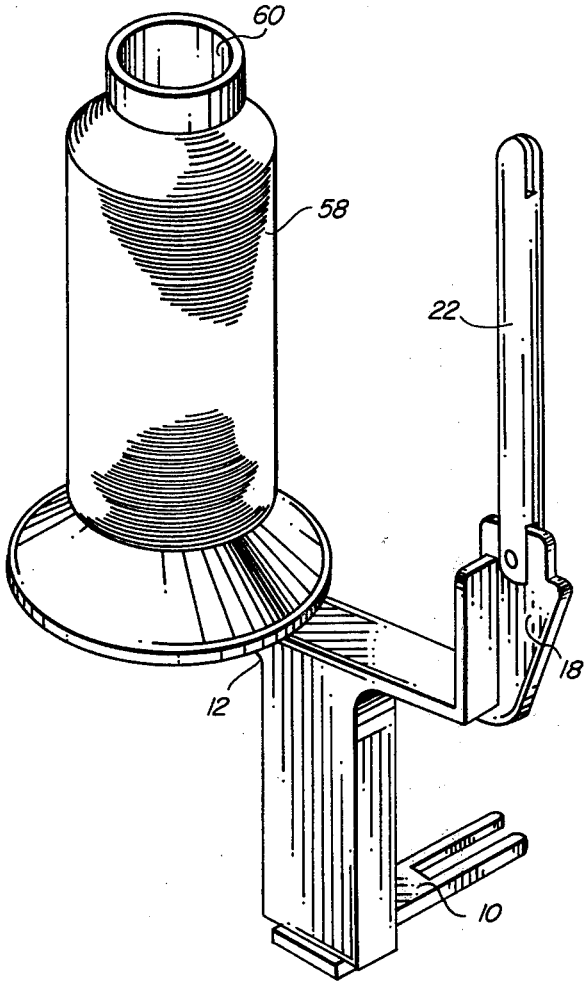
FIG. 6 is an isometric view of the inventive adapter with a large bore spool mounted on the cross fin of the adapter.
Figure 7:
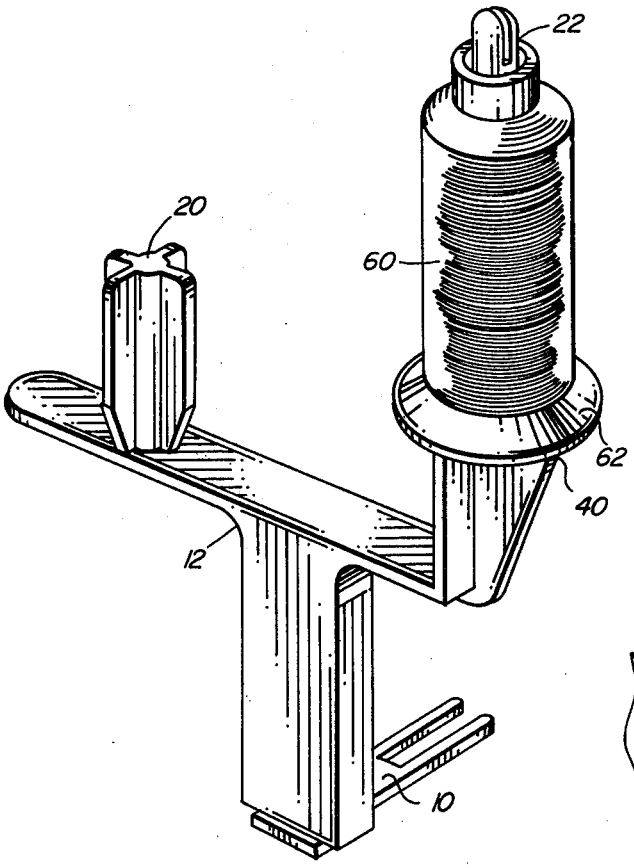
FIG. 7 is an isometric view of the inventive adapter supporting a small conical base spool of thread.

FIG. 6 illustrates the use of the inventive adapter for supporting a large spool of thread 58 having a large diameter bore 60 therethrough which is placed over cross-fin 20 (not shown). Such spools are usually conical and are mounted over cross-fin 20 in a vertical position. The cross fin provides a center of rotation for large spools and imparts a finite amount of drag on the spool so as to provide tension on the thread coming off the spool. It should be noted that this configuration is preferably used only for the purpose of filling bobbins. After the spool is properly positioned on cross-fin 20, the yoke should be rotated so that thread leaving spool 58 feeds directly to the first thread guide as was the case before. That is, the distance between the point on the spool at which the thread begins to leave the spool and the first thread guide should be minimized.

By placing rod 22 in a vertical position, the adapter can accommodate conical base spools 60 of intermediate size. Step 40 in mounting fin 18 (shown in FIG. 1) provides a ledge for supporting the base 62 of spool 60. Again, once the spool is properly positioned, the yoke is rotated to minimize the distance between the point at which the thread leaves spool 60 and the first thread guide.

Figure 8:
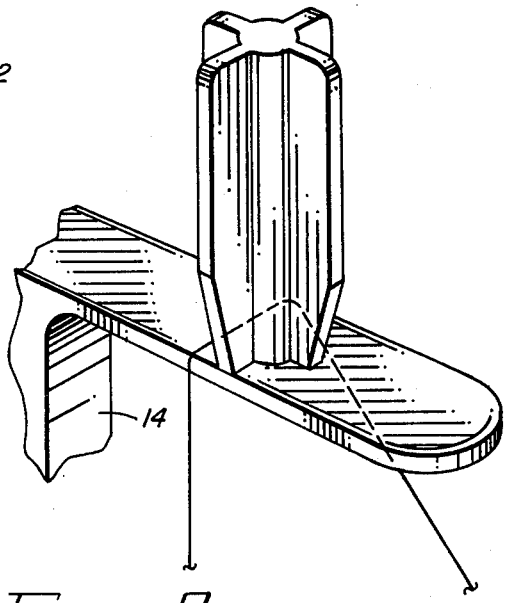
FIG. 8 illustrates how the inventive adapter may be used to guide thread from a spool of thread too large to be supported on the adapter.

In some cases, the spool may be too large to be supported on the adapter. In this case, the spool may be placed on the floor or a table directly below the adapter and the thread guided over horizontal portion 16 adjacent cross-fin 20 to the first thread guide as is shown in FIG. 8.

The above description is given by way of example only. Changes in form and details may be made by one skilled in the art without departing from the scope of the invention as defined by the appended claims.

What is claimed is:

1. An adapter for use on a sewing machine equipped with first and second spool pins, said adapter for enabling said machine to operate with non-conventional spools of thread such as plastic or cardboard tube spools, small conical base spools and large spools having a large bore therethrough, comprising:

first means for mounting said adapter on said spool pins;

yoke means rotatably coupled to said first means;

a first vertical mounting fin fixedly coupled to said yoke means;

a second vertical mounting fin fixedly coupled to said yoke means;

a mounting rod hingedly coupled to said first mounting fin and capable of assuming stable horizontal and vertical positions;

a compression finger hingedly coupled to the vertical yoke; and a stabilizing bar frictionally attached to the vertical yoke with discrete rotational intervals.

2. An adapter according to claim 1 wherein said stabilizing bar comprises an aperture therethrough at one end of said stabilizing bar and first and second prongs defining a slot there between and another end of said stabilizing bar.

3. An adapter according to claim 2 wherein said yoke means comprises a vertical section and a horizontal section mounted on said vertical section.

4. An adapter according to claim 3 wherein said vertical section has a bore extending through a portion thereof, said bore being aligned with said aperture to receive said first spool pin, said second spool pin being positioned within said slot.

5. An adapter according to claim 4 wherein said second mounting fin is a multiblade fin over which a spool having a bore of large diameter may be placed.

6. An adapter according to claim 5 wherein said first mounting fin is positioned at one end of said horizontal section and wherein said second mounting fin is positioned proximate an other end of said horizontal section.

7. An adapter according to claim 6 wherein said second mounting fin is equipped with stop means for engaging said rod when said rod is in a horizontal position.

8. An adapter according to claim 7 wherein said first mounting fin includes a step for supporting a spool mounted on said rod when said rod is in a vertical position.

* * * * *